US007350451B2

(12) United States Patent
Barisciano, Jr.

(10) Patent No.: US 7,350,451 B2
(45) Date of Patent: Apr. 1, 2008

(54) APPARATUS COMPRISING AN EXHAUST DUCT AND ANTI-FRATRICIDE SHIELD

(75) Inventor: Lawrence P. Barisciano, Jr., Hampstead, MD (US)

(73) Assignee: Lockheed Martin Corporation, Bethesda, MD (US)

( * ) Notice: Subject to any disclaimer, the term of this patent is extended or adjusted under 35 U.S.C. 154(b) by 0 days.

(21) Appl. No.: 11/272,263

(22) Filed: Nov. 10, 2005

(65) Prior Publication Data

US 2008/0041222 A1 Feb. 21, 2008

(51) Int. Cl.
*F41H 5/00* (2006.01)

(52) U.S. Cl. ..... 89/36.15; 89/36.01

(58) Field of Classification Search ..... 89/1.804, 89/1.812, 1.815, 1.816, 1.817, 1.818, 36.12, 89/36.17; 206/3, 443, 593; 376/272
See application file for complete search history.

(56) References Cited

U.S. PATENT DOCUMENTS 2,792,962 A * 5/1957 Granfelt ..... 220/507
3,319,522 A * 5/1967 Gould et al. ..... 89/1.813
4,222,484 A * 9/1980 Howe ..... 206/3
4,286,708 A * 9/1981 Porzel ..... 206/3
4,604,939 A * 8/1986 Hoffmeister et al. ..... 89/1.816
4,649,018 A * 3/1987 Waltersdorf et al. ..... 376/272
4,747,350 A * 5/1988 Szecket ..... 102/306
4,842,182 A * 6/1989 Szecket ..... 228/108
4,887,761 A * 12/1989 Hardwick ..... 228/107
4,934,241 A * 6/1990 Piesik ..... 89/1.817
5,158,173 A * 10/1992 Halsey et al. ..... 206/3
5,206,450 A * 4/1993 Piesik ..... 89/1.8
5,837,919 A * 11/1998 Yagla et al. ..... 89/1.816
6,230,604 B1 * 5/2001 Larson et al. ..... 89/1.817
6,422,514 B1 * 7/2002 Clark et al. ..... 244/135 R
6,526,860 B2 * 3/2003 Facciano et al. ..... 89/1.801
6,584,882 B2 7/2003 Briggs et al.
6,971,300 B2 * 12/2005 Kunstmann ..... 89/1.816
7,066,320 B2 * 6/2006 Sansolo ..... 206/3
2006/0021497 A1 * 2/2006 Paul et al. ..... 89/1.815
2006/0096449 A1 * 5/2006 Williams et al. ..... 89/1.817

* cited by examiner

*Primary Examiner*—Michael J. Carone
*Assistant Examiner*—Stewart T Knox
(74) *Attorney, Agent, or Firm*—DeMont & Breyer LLC

(57) ABSTRACT

A missile launcher that combines the functionality of a gas management system and an anti-fratricide shield is disclosed. In accordance with the illustrative embodiment of the present invention, a plurality of gas-uptake ducts are arranged on a boundary that surrounds a missile, thereby providing a barrier to the propagation of blast energy and/or fragments across the boundary.

9 Claims, 8 Drawing Sheets

APPARATUS COMPRISING AN EXHAUST DUCT AND ANTI-FRATRICIDE SHIELD

FIELD OF THE INVENTION

The present invention relates to missilery in general, and, more particularly, to missile launchers.

BACKGROUND OF THE INVENTION

Multi-cell missile launchers are often used on ships and other military vehicles. Since it is an offensive weapon, a missile launcher is likely to be targeted by enemy combatants. If one of the missiles in a multi-cell missile launcher is hit by an enemy strike, it is possible that the missile will explode. The explosion of one of the missiles within a multi-cell missile launcher can trigger a chain reaction in which another missile within the launcher also explodes. While a ship, especially a larger one, might be able to withstand a strike from a single missile, the detonation of multiple missiles within a multi-cell missile launcher can destroy a ship.

To decrease the likelihood of a chain reaction, each individual cell in a multi-cell missile launcher is usually armored with an "anti-fratricide shield." Conventional anti-fratricide shields are typically metal plates or sandwich panels that are located between missiles. As such, they add weight and expense and consume valuable space in the launcher.

SUMMARY OF THE INVENTION

The present invention provides an improved missile launcher that combines the functionality of an anti-fratricide shield with that of a gas management system. In accordance with the illustrative embodiment of the present invention, a plurality of gas-uptake ducts are arranged on a boundary that surrounds a missile, thereby providing a barrier to the propagation of blast energy and/or fragments across the boundary.

In the illustrative embodiment, the ducts are designed to attenuate some or all of the energy of a pressure wave propagating toward or away from the missile. Attenuation is accomplished by at least one of: deflecting some of the energy into a different direction; absorbing some of the energy; and converting some of the energy into another form of energy such as heat, etc. In addition, the ducts are designed to withstand impact of high-velocity fragments, such as those in motion due to the explosion of a missile. The ducts deflect and/or absorb and/or decelerate such fragments so as to limit damage to the missile below a missile damage threshold.

In some embodiments of the present invention, additional shielding capacity is added to the ducts by the addition of energy-absorbing material around the ducts.

DETAILED DESCRIPTION

For the purposes of this Specification, including the appended claims:

- the term Blast energy is defined as the energy of a pressure wave that results from an explosion.
- the term Duct is defined as a hollow conveyance for gas or liquid.
- the term Energy-absorbing material is defined as material that is intended to attenuate blast energy. Such material may absorb a portion of the blast energy or convert a portion of the blast energy into another form of energy, such as heat, etc. Examples of materials that are suitable, as a function of the application, for use as energy-absorbing materials include, without limitation, thermally-stable gelatin, sand, non-flammable gas, silicon gel, pumice, ceramic aggregate, incompressible fluids, and water. Examples of materials that are NOT suitable for use as energy-absorbing materials include air, unless such air is part of a baffle system designed to absorb blast energy.

The heat signature due to a missile launch can often make a missile launcher one of the more detectable features of a warship. In addition, the launch of a missile generates significant noxious and/or toxic gas. In order to protect personnel, as well as reduce the heat signature of the missile launcher exhaust gas is vented away from the missile launcher by means of a gas management system.

A conventional gas management system includes a plenum for receiving exhaust gas from the launch cells, and a common uptake duct for venting the exhaust gas out of the plenum into the atmosphere away from the missile launcher. The uptake duct is typically quite large, since it must accommodate a significant amount of gas flow. As a result, the uptake duct consumes valuable space in the launcher, and can even supplant one or more potential launch cell sites and thus reduce the firepower of the warship.

An aspect of the present invention is the recognition that the functionalities of the uptake duct and anti-fratricide shield can be combined into a single system. A combination of these functionalities into a single system enables potential reduction of cost, weight, and space.

Figure 1:
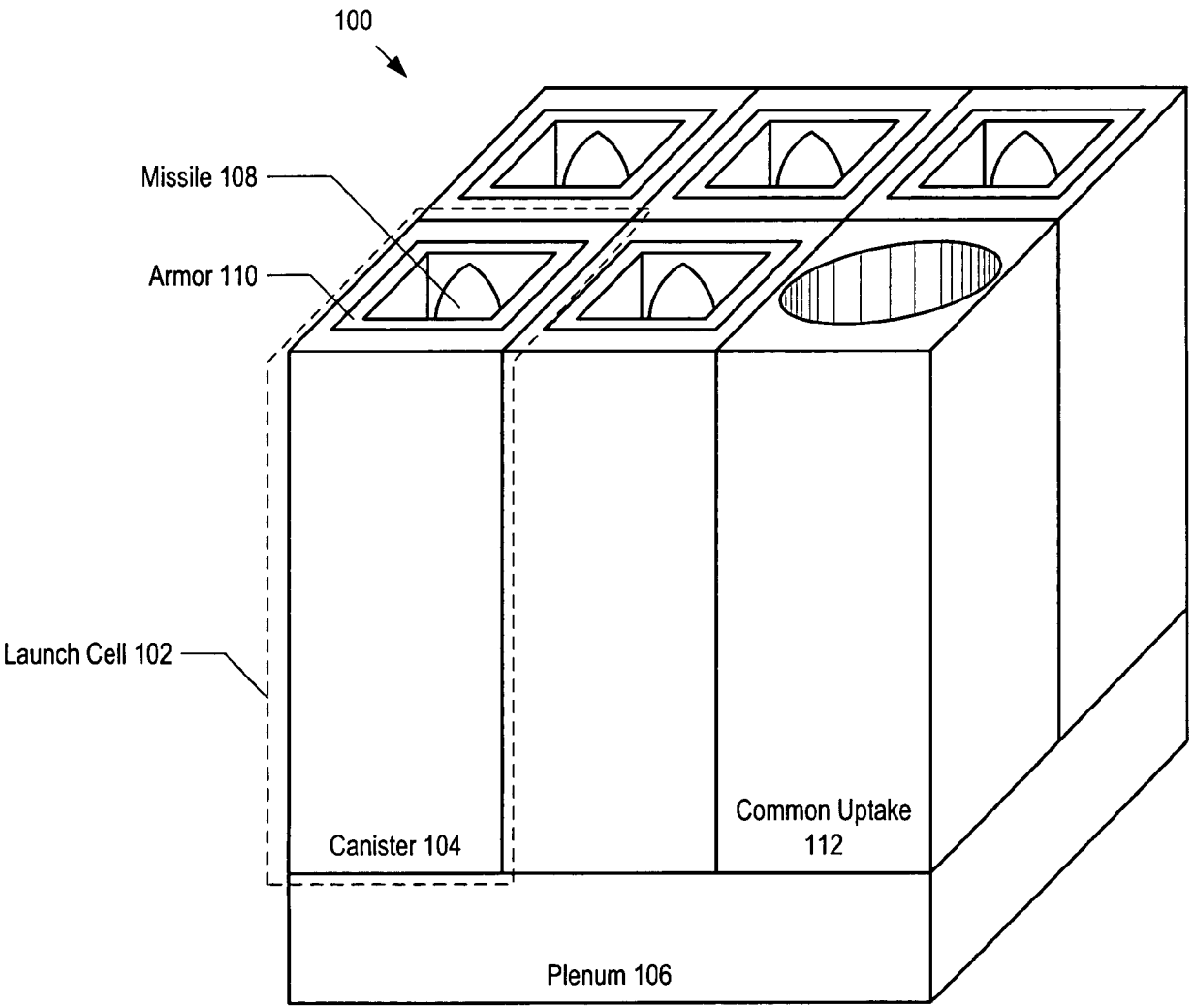
Figure 1 (Prior Art)
FIG. 1 depicts a perspective view of the salient features of a multi-cell missile launcher known in the prior art.

FIG. 1 depicts a perspective view of the salient features of a multi-cell missile launcher as is known in the prior art. Missile launcher 100 comprises five identical launch cells 102, plenum 106, and common uptake 112. Exhaust gasses generated in launch cells 102 are received by plenum 106. Common uptake 112 vents theses gases from plenum 106.

Each launch cell 102 comprises canister 104, missile 108, and armor 110. Canister 104 provides infrastructure for supporting the storage, transportation and launching of missile 108.

Armor 110 provides protection for missile 108 from explosions external to canister 104. For example, armor 110 decreases the likelihood of the detonation of missile 108 due to the explosion of a missile in an adjacent launch cell (i.e., missile "fratricide"). Anti-fratricide armor is disclosed by T. K. Shah, et al., in U.S. patent application Ser. No. 11/186,650 entitled "Apparatus Comprising Armor," which is incorporated by reference in its entirety. Armor 110 increases the size, weight and cost of each launch cell, however.

Common uptake 112 provides a route for venting exhaust gas generated during missile launch into the outside environment. In some cases, missile launcher 100 is mounted below the deck of a warship, and common uptake 112 conveys gas to an area above deck and away from personnel. In order for common uptake 112 to accommodate multiple missile launches, however, it must be sized sufficiently. Common uptake 112 can require significant space in missile launcher 100 reducing the number of launch cells, such as depicted in FIG. 1.

Figure 2:
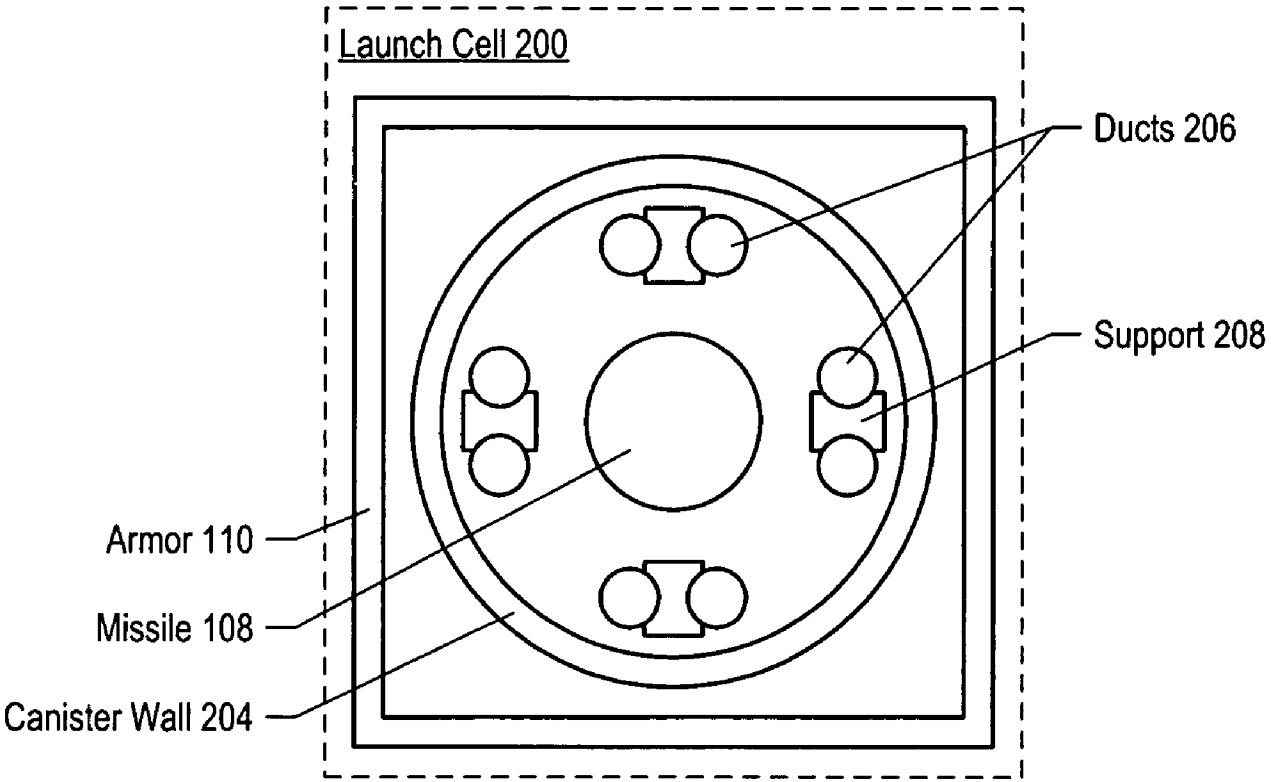
Figure 2 (Prior Art)
FIG. 2 depicts a top view of the salient features of a launch cell as is known in the prior art.

FIG. 2 depicts a top view of the salient features of a launch cell as is known in the prior art. Launch cell 200 comprises missile 108, canister wall 204, ducts 206, supports 208, and armor 110.

Canister wall 204 is part of a missile canister that encloses missile 108 in well-known fashion.

Ducts 206 are mechanically supported by supports 208, and together ducts 206 provide a distributed uptake configuration for venting exhaust gas generated during the launch of missile 108. As disclosed in U.S. Pat. No. 6,584,882 entitled "Self-contained Canister Missile Launcher with Tubular Exhaust Uptake Ducts," issued on Jul. 1, 2003 to D. C. Briggs, et al., ducts 206 are designed to resist exhaust pressure in hoop tension. A cylinder wall is stronger in hoop tension than in compression; therefore, ducts 206 can be made lightweight so as to reduce the size and weight of launch cell 200. Lightweight ducts, however, provide little or no resistance to externally applied forces such as those associated with the explosion of a missile in an adjacent launch cell.

Figure 3:
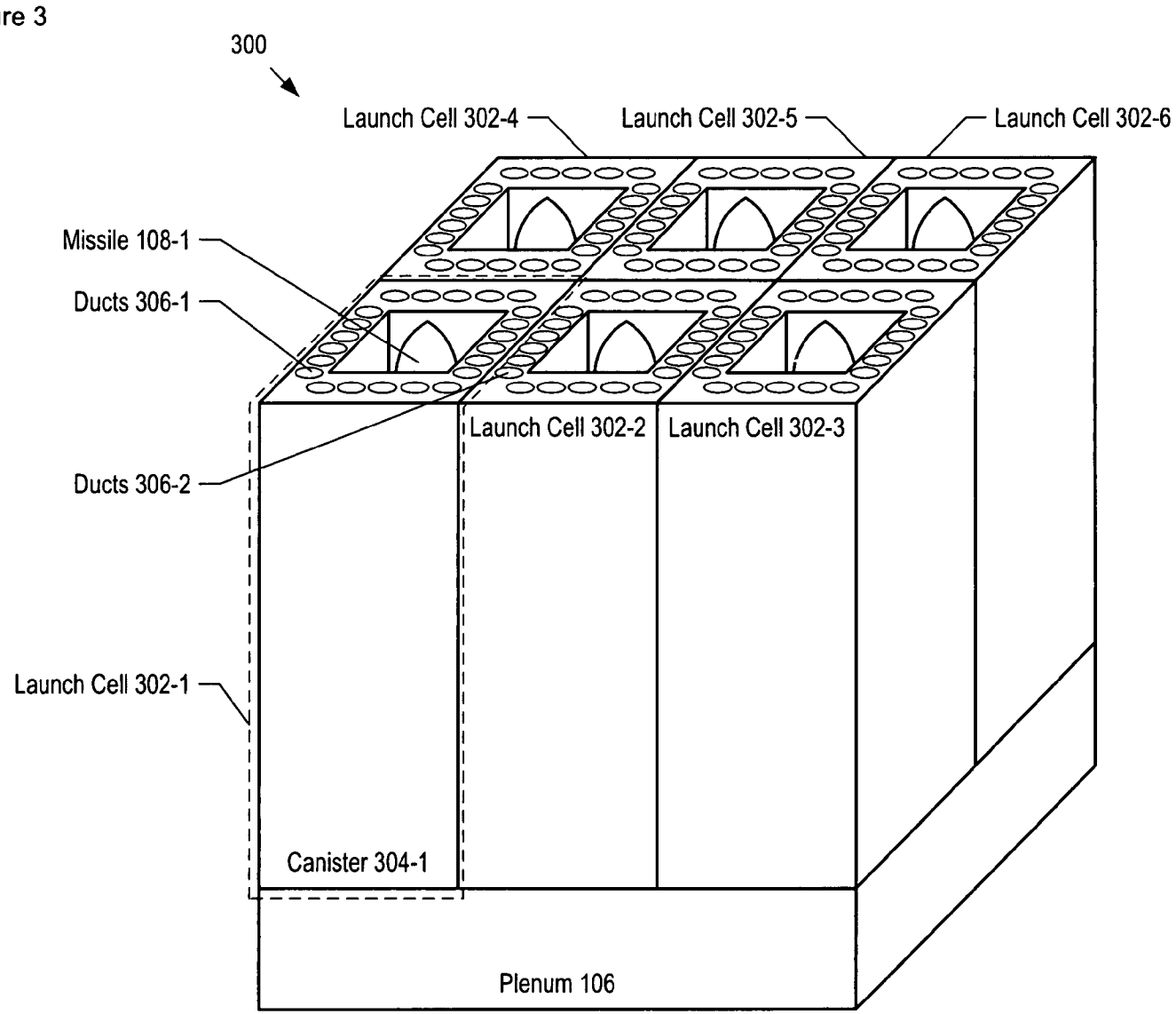
FIG. 3 depicts a perspective view of the salient features of a multi-cell missile launcher according to the illustrative embodiment of the present invention.

FIG. 3 depicts a perspective view of the salient features of a multi-cell missile launcher according to the illustrative embodiment of the present invention. Multi-cell missile launcher 300 comprises launch cells 302-1 through 302-6, and plenum 106.

Launch cell 302-1 (representative of all launch cells 302-1 through 302-6) comprises canister 304-1 missile 108-1, and ducts 306-1. As will be discussed below and with respect to FIG. 4A, ducts **306-*i*, i is an integer from 1 to 6, collectively compose anti-fratricide shield 406-*i* (hereinafter referred to as shield 406-*i*) of launch cell 302-*i*. For example, ducts 306-1 collectively compose anti-fratricide shield 406-1 of launch cell 302-1 and, in similar fashion, ducts 306-2 collectively compose anti-fratricide shield 406-2 of launch cell 302-2**, and so on.

Plenum 106 comprises a chamber with six gas ports (not shown), one gas port for each launch cell. Launch cells 302-1 through 302-6 mount to plenum 106 to enable gas flow from canisters 304-1 through 304-6 into plenum 106 through the gas ports.

Plenum 106 receives gas from launch cells 302-1 through 302-6. The gas received by plenum 106 may be exhaust gas generated during launch of a missile or gas that outgases from a missile prior to launch.

Ducts 306-1 comprise steel tubes that have a circular cross-section. Ducts 306-1 are designed so that they collectively provide sufficient cross-sectional area to vent the high-pressure exhaust gas generated by missile 108-1 during launch. In similar fashion to the prior art, ducts 306-1 require sufficient hoop tensile strength to withstand the gas pressure generated within the ducts during the launch of missile 108-1. In contrast to the prior art, however, ducts 306-1 are meant to serve the dual purpose of forming a shield for missile 108-1 from damage caused by an explosion external to canister 304-1. Ducts 306-1 are also meant to form a shield to provide protection for adjacent missiles and/or nearby personnel from an explosion of missile 108-1 while within launch cell 302-1.

Ducts 306-1 protect missile 108-1 from damage caused by the pressure wave that results from the explosion and/or fragments cast toward missile 108-1 due to an explosion external to canister 304-1. In order to form a shield, therefore, ducts 306-1 must enable the attenuation of blast energy that reaches missile 108-1 and/or deflect, decelerate, or block damaging fragments cast toward missile 108-1 due to the explosion.

The blast energy can be reduced before it reaches missile 108-1 by:

(i) changing the direction the propagation of at least a portion of the blast energy; or (ii) absorbing at least a portion of the blast energy; or (iii) converting at least a portion of the blast energy into another form of energy (e.g., heat, etc.); or (iv) any combination of (i) through (iii).

Ducts 306-1, therefore, are subject to design constraints that enable them to provide means for one or more of (i), (ii), and (iii) above. In some embodiments, ducts 306-1 form a solid border that blocks the radial propagation of the pressure wave. In some other embodiments, ducts 306-1 comprise a wall thickness sufficient to block some of the radial propagation of the pressure wave, while also deforming inwardly (i.e., crumpling) to convert blast energy into heat or otherwise "consume" blast energy. In some other embodiments, ducts 306-1 comprise a wall thickness sufficient to confine the blast energy within canister 304-1. In still some other embodiments, ducts 306-1 comprise fins that are appropriately configured to explosively weld when exposed to blast energy, thereby consuming a portion of the blast energy.

Figure 4A:
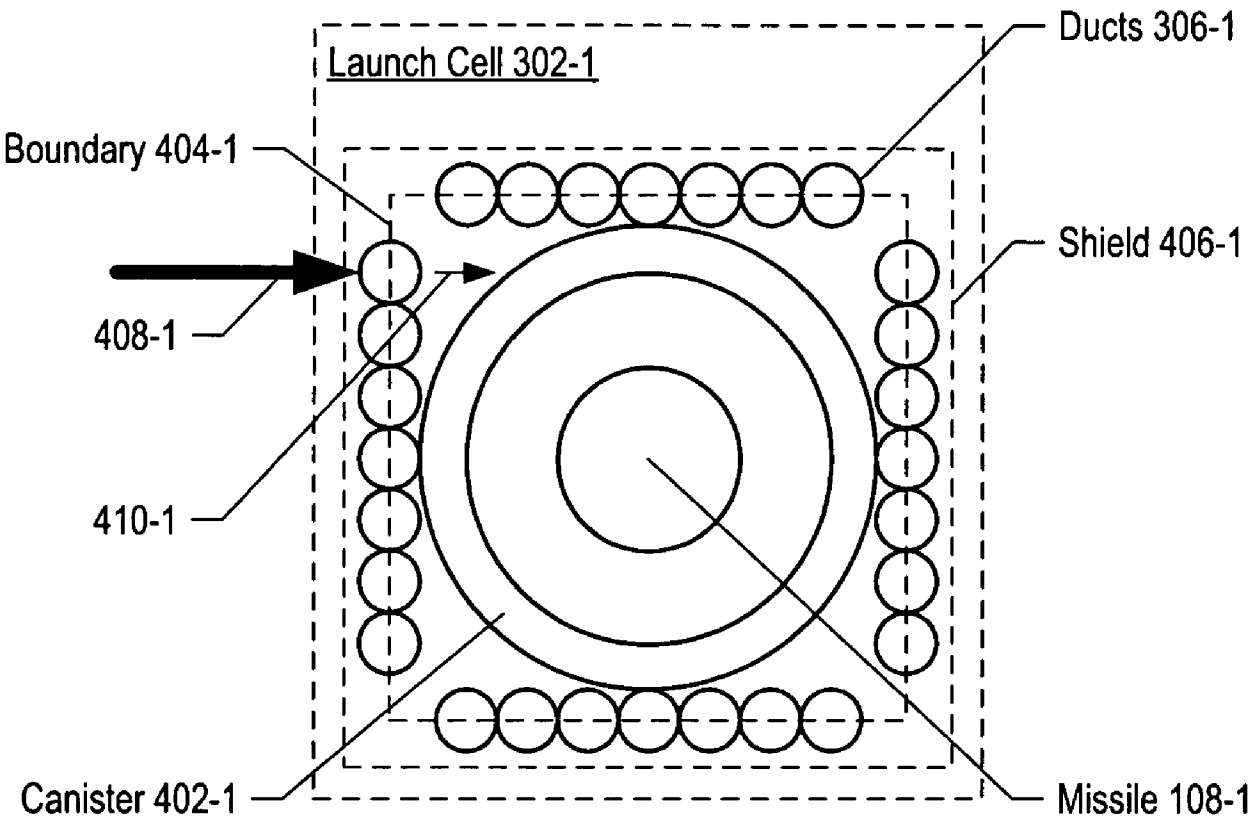
FIG. 4A depicts a top view of the salient components of a launch cell according to the illustrative embodiment of the present invention.

FIG. 4A depicts a top view of the salient components of a launch cell according to the illustrative embodiment of the present invention. Launch cell 302-1 comprises missile 108-1, canister 402-1, and shield 406-1.

Canister 402-1 is a circular missile enclosure as is well-known in the prior art.

Shield 406-1 comprises twenty-eight of ducts 306-1, which lie on boundary 404-1. Each of ducts 306-1 comprises a steel tube that has a circular cross-section. Duct 306-1 has an outer diameter substantially equal to 6 inches and a wall thickness substantially equal to 0.25 inches.

Ducts 306-1 are arranged on boundary 404-1 to prevent a portion of external pressure wave 408-1 from propagating through boundary 404-1. As a result, internal pressure wave 410-1 is limited to a level below a damage threshold of missile 108-1.

Figure 4B:
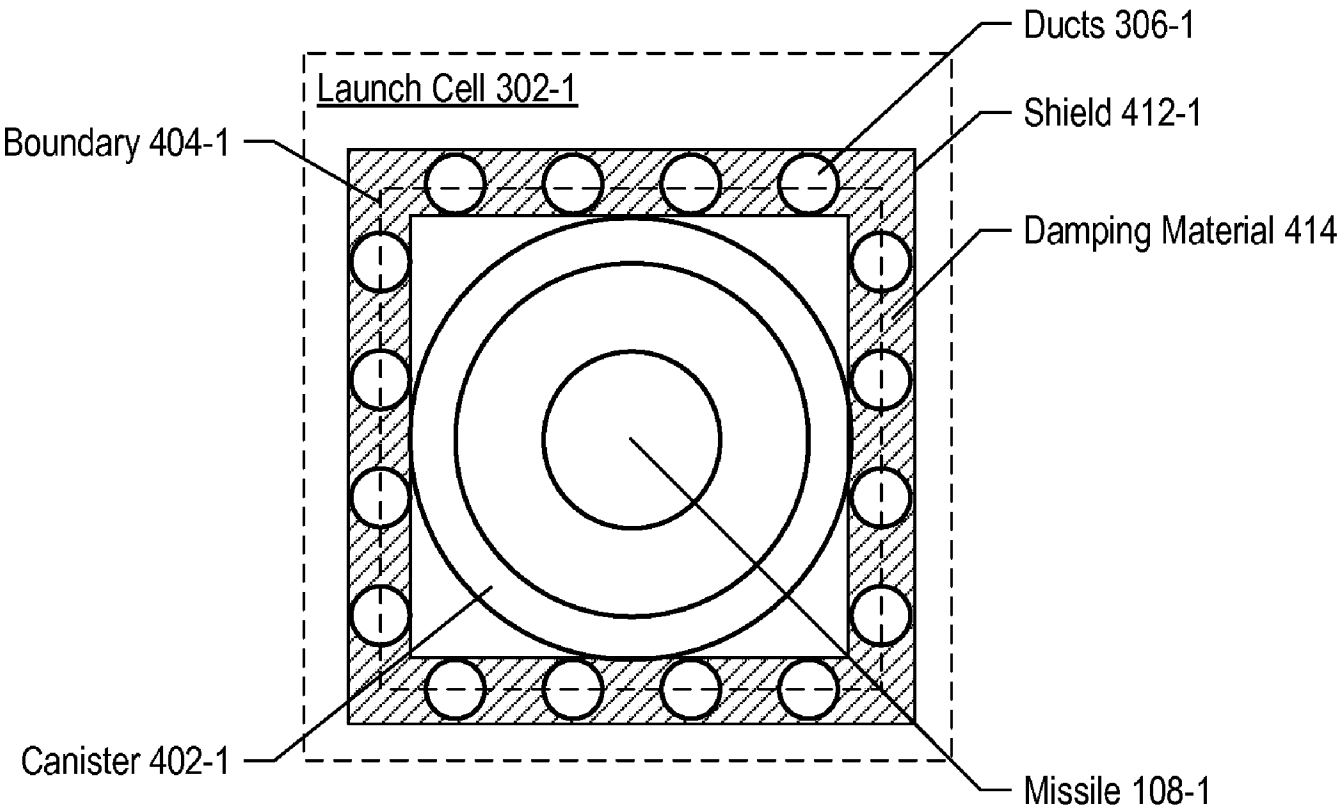
FIG. 4B depicts a top view of the salient components of a launch cell according to an alternative embodiment of the present invention.

FIG. 4B depicts a top view of the salient components of a launch cell according to an alternative embodiment of the present invention. Launch cell 302-1 comprises missile 108-1, canister 402-1, and shield 412-1.

Shield 412-1 comprises ducts 306-1 and damping material 414. Ducts 306-1 are arranged on boundary 404-1. The volume of shield 412-1 between ducts 306-1 is filled with energy-absorbing material 414 to further enhance the energy attenuation-capability of shield 412-1.

In the alternative embodiment, damping material 414 is a thermally-stable gelatin, however other suitable damping materials include, without limitation: sand, non-flammable gas, silicon gel, pumice, and water. In some alternative embodiments, damping material 414 retards the spread of fire.

Although shield 412-1 forms a continuous border that surrounds canister 402-1, in some alternative embodiments, shield 412-1 forms a discontinuous border. In some other alternative embodiments, shield 412-1 is located within canister 402-1.

Figure 4C:
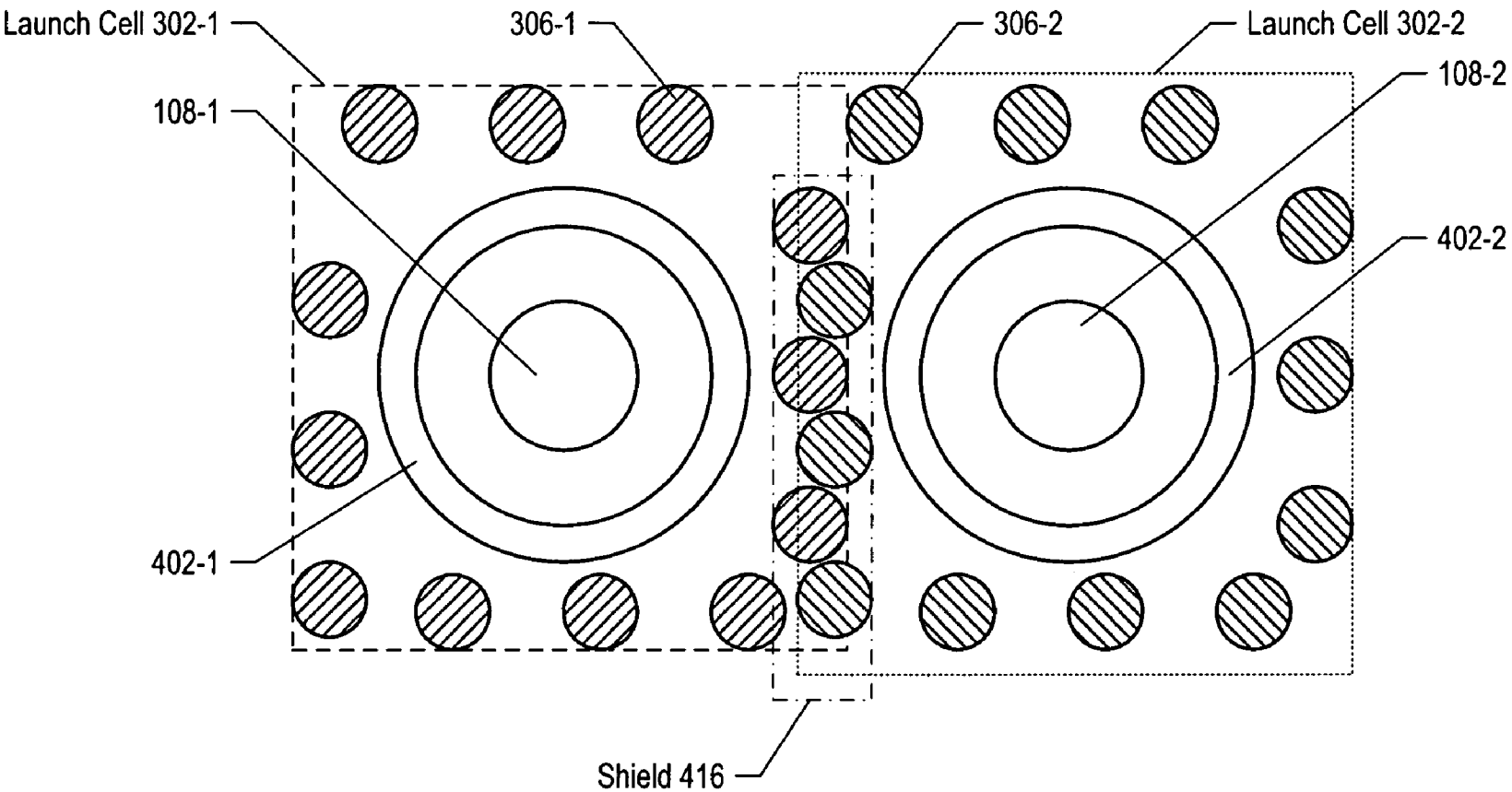
FIG. 4C depicts a top view of the salient components of adjacent launch cells nested to form a composite shield according to an alternative embodiment of the present invention.

FIG. 4C depicts a top view of the salient components of adjacent launch cells nested to form a composite shield according to an alternative embodiment of the present invention. Launch cell 302-1 comprises missile 108-1, canister 402-1, and ducts 306-1. Launch cell 302-2 comprises missile 108-2, canister 402-2, and ducts 306-2.

Shield 416 provides protection from an explosion in launch cell 302-2 for missile 108-1, and protection from an explosion in launch cell 302-1 for missile 108-2. Shield 416 is formed when launch cells 302-1 and 302-2 are mounted in multi-cell launcher 300, thereby tiling three of ducts 306-1 and three of ducts 306-2 together. Since only half of the ducts that compose shield 416 are included in each launch cell, the size, weight, and cost of each launch cell are reduced. It will be clear to those skilled in the art, after reading this specification, how to make and use alternative embodiments of the present invention that comprise:

(i) fewer ducts per launch cell; or
(ii) more ducts per launch cell; or
(iii) a different arrangement of ducts; or
(iv) ducts of different sizes; or
(v) ducts of different shapes; or
(vi) ducts of different materials; or
(vii) any combination of (i), (ii), (iii), (iv), (v), and (vi).

Figure 5C:
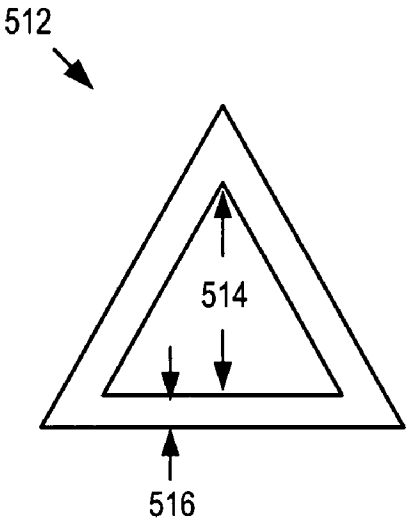
FIG. 5C depicts a top view of the salient components of a duct according to an alternative embodiment of the present invention.
Figure 5A:
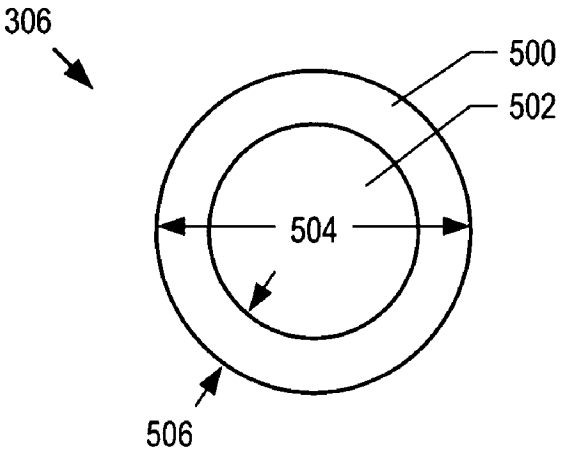
FIG. 5A depicts a top view of the salient components of a duct according to the illustrative embodiment of the present invention.

FIG. 5A depicts a top view of the salient components of a duct according to the illustrative embodiment of the present invention. Duct 306 comprises a steel tube with a cylindrical cross-section having cylindrical wall 500 and channel 502. Duct 306 is characterized by outer diameter 504 and wall thickness 506. Outer diameter 504 is substantially equal to 6 inches. Wall thickness 506 is substantially equal to 0.25 inches. Channel 502 and wall thickness 506 are specified based on a set of parameters that include: the type of missile; the number of launch sites; exhaust requirement; and the type of multi-cell missile launcher. It will be clear to those skilled in the art, after reading this specification, how to make and use alternative embodiments of the present invention that comprise an outer diameter other than 6 inches and/or wall thickness other than 0.25 inches.

Figure 5B:
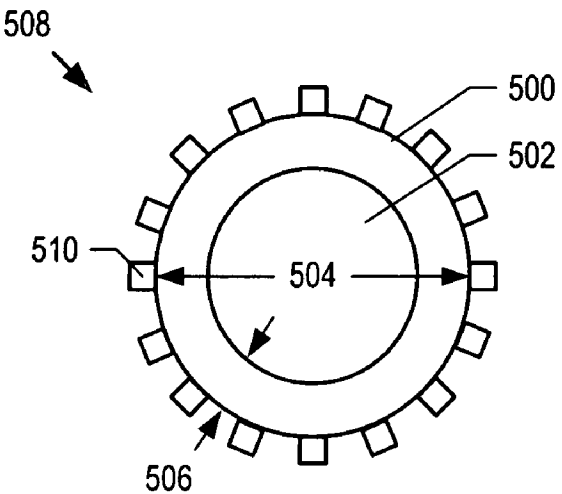
FIG. 5B depicts a top view of the salient components of a duct according to an alternative embodiment of the present invention.

FIG. 5B depicts a top view of the salient components of a duct according to an alternative embodiment of the present invention. Duct 508 comprises a steel tube having cylindrical wall 500, channel 502, and projections 510. Duct 508 is characterized by outer diameter 504 and wall thickness 506. Outer diameter 504 is substantially equal to 5.5 inches. Wall thickness 506 is substantially equal to 0.25 inches.

Projections 510 are steel projections that are disposed at an acute angle from the outer surface of cylindrical wall 500. Projections 510 are appropriately configured to explosively weld when exposed to blast energy. Projections 510 will be described below and in reference to FIG. 6. The process of explosive welding projections 510 consumes a portion of the blast energy, thereby enhancing the protection provided by shield 412-1.

FIG. 5C depicts a top view of the salient components of a duct according to an alternative embodiment of the present invention. Duct 512 comprises a steel tube having a triangular cross-section. Duct 512 is characterized by channel height 514 and wall thickness 516. Channel height 514 is substantially equal to 7 inches, and wall thickness 516 is substantially equal to 0.25 inches.

The triangular cross-section of duct 512 provides a different nesting capability than that of a duct with a cylindrical cross-section. In some embodiments, a triangular duct provides a higher strength-to-weight ratio than ducts of other cross-sectional shapes for a comparable exhaust capacity, thereby enabling a lighter and/or smaller and/or cheaper launch cell.

Figure 6B:
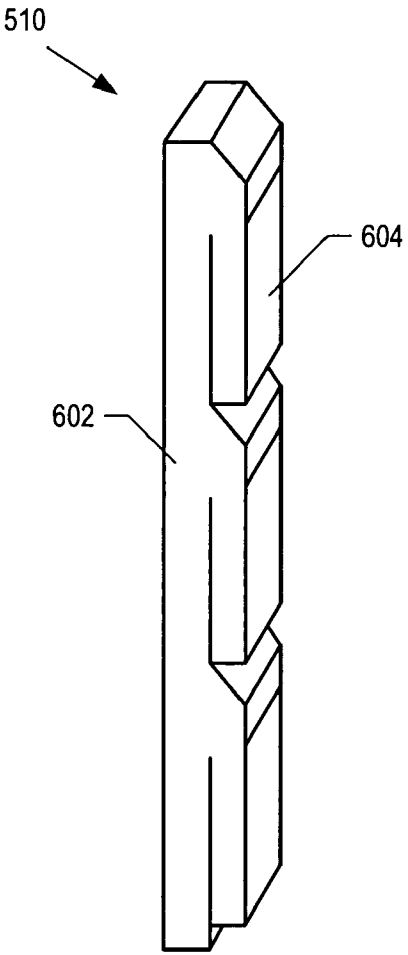
FIG. 6B depicts a perspective view of projection 510 after exposure to blast energy according to an alternative embodiment of the present invention.
Figure 6A:
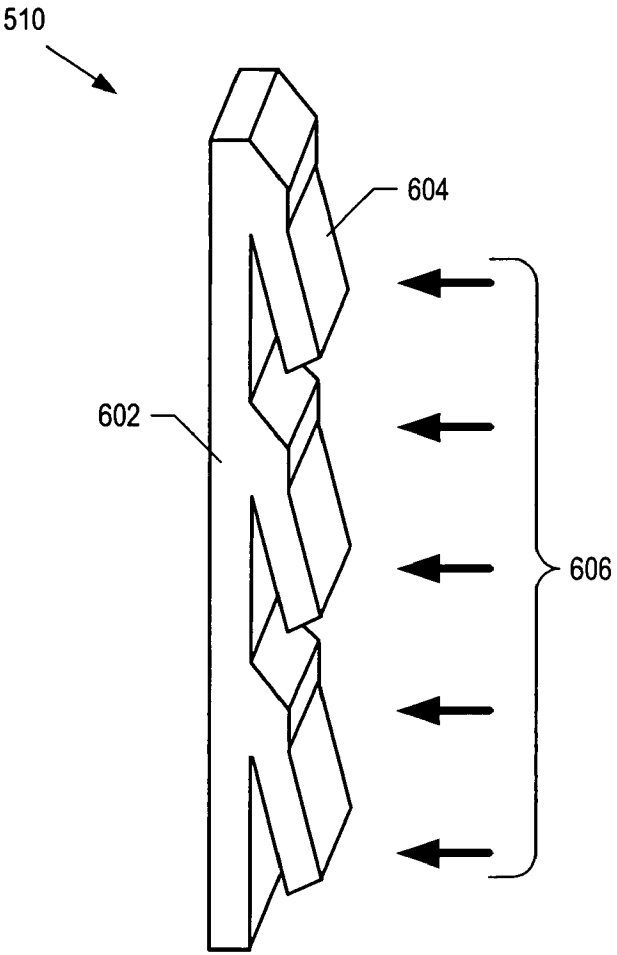
FIG. 6A depicts a perspective view of projection 510 before exposure to blast energy according to an alternative embodiment of the present invention.

FIGS. 6A and 6B depict perspective views of projection 510 before and after exposure to blast energy, respectively, according to an alternative embodiment of the present invention. Projection 510 comprises spline 602 and fins 604.

Spline 602 is a steel strip suitable for mounting to the outer surface of cylindrical wall 500. Spine 602 may be mounted to cylindrical wall by welds, rivets, or screws.

Fins 604 are steel tabs affixed to spline 602. Prior to exposure to blast energy and as depicted in FIG. 6A, fins 604 are disposed at an acute angle relative to spline 602, as required for explosive welding. When exposed to blast energy 606, fins 604 are driven into spline 602 with such force that the metallic fins weld to the metallic spline. FIG. 6B depicts projection 510 after exposure to blast energy.

Explosive welding induces changes to both the macro- and micro-structure of projections 510. One change at the micro level is that the welded material (at least near the welding interface) is "hardened" relative to its pre-welded state. In this hardened state, the materials are better able to resist penetration by blast fragments. Since the propagation of blast fragments lags the pressure wave created by the explosion, the fragments encounter the "hardened" welded structure rather than the pre-welded structure. As a result, a reduced number of blast fragments propagate beyond the first layer, relative to what would otherwise be the case.

It is notable that in the prior art, an enhanced ability to contain blast fragments would come at the expense of additional weight or require the use of exotic materials. And, of course, the weight and price penalties of additional and/or exotic materials must be paid whether or not this extra protection is used; that is, whether or not there is a strategic hit on a missile within a multi-cell launcher. But this is not the case with embodiments of the present invention, wherein the enhanced ability comes as a serendipitous result of the process of explosive welding. In other words, the enhanced ability is not present until it is needed, and it's provided at no additional "cost."

It is to be understood that the above-described embodiments are merely illustrative of the present invention and that many variations of the above-described embodiments can be devised by those skilled in the art without departing from the scope of the invention. For example, in this Specification, numerous specific details are provided in order to provide a thorough description and understanding of the illustrative embodiments of the present invention. Those skilled in the art will recognize, however, that the invention can be practiced without one or more of those details, or with other methods, materials, components, etc.

Furthermore, in some instances, well-known structures, materials, or operations are not shown or described in detail to avoid obscuring aspects of the illustrative embodiments. It is understood that the various embodiments shown in the Figures are illustrative, and are not necessarily drawn to scale. Reference throughout the specification to "one embodiment" or "an embodiment" or "some embodiments" means that a particular feature, structure, material, or characteristic described in connection with the embodiment(s) is included in at least one embodiment of the present invention, but not necessarily all embodiments. Consequently, the appearances of the phrase "in one embodiment," "in an embodiment," or "in some embodiments" in various places throughout the Specification are not necessarily all referring to the same embodiment. Furthermore, the particular features, structures, materials, or characteristics can be combined in any suitable manner in one or more embodiments. It is therefore intended that such variations be included within the scope of the following claims and their equivalents.

What is claimed is:

1. A munitions launcher comprising:

a first canister having a first cavity, wherein said first canister comprises a first physical-adaptation for receiving a first munition in said first cavity;

a second canister having a second cavity, wherein said second canister comprises a second physical-adaptation for receiving a second munition in said second cavity, wherein said second munition is susceptible to detonation due to the explosion of said first munition; and a plurality of ducts for conveying gas from said first canister, wherein said plurality of ducts collectively define a substantially continuous shield that interposes and substantially separates said first cavity and said second cavity, and wherein at least one of said plurality of ducts comprises a third physical-adaptation for limiting damage to said second munition caused by an explosion of said first munition to a level below that required to detonate said second munition.

2. The apparatus of claim 1 further comprising energy-absorbing material, wherein said energy-absorbing material interposes said first cavity and said second cavity, and wherein said energy absorbing material is selected from the group consisting of thermally-stable gelatins, sand, silica gels, pumice, ceramic aggregate, noble gases, and incompressible fluids.

3. The apparatus of claim 1 wherein at least one of said plurality of ducts comprises a hollow tube having a circular cross-section.

4. The apparatus of claim 1 wherein at least one of said plurality of ducts comprises a hollow tube having a triangular cross-section.

5. The apparatus of claim 1 wherein said third physical-adaptation comprises a duct wall that includes a first layer and at least one projection, wherein said projection is configured to explosively weld to said first layer when exposed to blast energy from the explosion of said first munition.

6. The apparatus of claim 1 further comprising:

said first munition; and said second munition.

7. The apparatus of claim 1 further comprising a plenum for receiving gas from at least one of said first canister and said second canister, wherein at least one of said plurality of ducts comprises a physical-adaptation for venting said gas from said plenum.

8. The apparatus of claim 1 wherein at least one of said plurality of ducts comprises a hollow tube having a duct wall having a first layer and a second layer, wherein said first layer explosively welds to said second layer when exposed to blast energy from the explosion of said first munition.

9. An apparatus comprising:

a first canister having a first cavity, wherein said first canister comprises a first physical-adaptation for receiving a munition in said first cavity;

a second canister having a second cavity, wherein said second canister comprises a second physical-adaptation for receiving a munition in said second cavity; and a plurality of ducts for conveying gas from said first canister, wherein said plurality of ducts compose a substantially continuous barrier for impeding the propagation of blast energy, and wherein said barrier interposes and substantially separates said first cavity and said second cavity, and wherein at least one of said plurality of ducts comprises a hollow tube having a duct wall having a first layer and at least one projection, wherein said projection is configured to explosively weld to said first layer when exposed to blast energy from the explosion of said first munition.

* * * * *